US009903368B2

(12) United States Patent
Tsuka

(10) Patent No.: US 9,903,368 B2
(45) Date of Patent: Feb. 27, 2018

(54) SCROLL COMPRESSOR

(71) Applicant: DAIKIN INDUSTRIES, LTD., Osaka-shi, Osaka (JP)

(72) Inventor: Yoshitomo Tsuka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 145 days.

(21) Appl. No.: 14/912,390

(22) PCT Filed: Jul. 10, 2014

(86) PCT No.: PCT/JP2014/003684
§ 371 (c)(1),
(2) Date: Feb. 16, 2016

(87) PCT Pub. No.: WO2015/025459
PCT Pub. Date: Feb. 26, 2015

(65) Prior Publication Data

US 2016/0208800 A1 Jul. 21, 2016

(30) Foreign Application Priority Data

Aug. 19, 2013 (JP) ..... 2013-169562

(51) Int. Cl.
*F04C 18/02* (2006.01)
*F04C 29/00* (2006.01)
*F04C 29/12* (2006.01)

(52) U.S. Cl.
CPC ..... *F04C 18/0261* (2013.01); *F04C 18/0215* (2013.01); *F04C 18/0253* (2013.01);
(Continued)

(58) Field of Classification Search
CPC ..... F04C 18/0215; F04C 18/0253; F04C 18/0261; F04C 18/0269; F04C 29/0057; F04C 29/12
(Continued)

(56) References Cited

FOREIGN PATENT DOCUMENTS

CN 104235016 A 12/2014
JP 7-189937 A 7/1995
(Continued)

OTHER PUBLICATIONS

Machine Translation JP 2000-110749.*
(Continued)

*Primary Examiner* — Patrick Maines
*Assistant Examiner* — Dapinder Singh
(74) *Attorney, Agent, or Firm* — Global IP Counselors, LLP

(57) ABSTRACT

A scroll compressor includes fixed and movable scrolls and a crank shaft coupled to the movable scroll. The fixed and movable wraps are engaged to form a compression chamber. A refrigerant compressed in the compression chamber is discharged from a discharge port open at a central portion of the fixed end plate. The compression chamber is divided into first and second compression chambers facing outer and inner circumferential surfaces of the movable wrap. One of the end plates is provided with a communication groove recessed at a portion near a wrapping start position of the wrap. The communication groove connects the first compression chamber and the discharge port before the outer circumferential surface of the movable wrap, which is eccentrically rotating while sliding on an inner circumferential surface of the fixed wrap, separates from the inner circumferential surface of the fixed wrap.

7 Claims, 6 Drawing Sheets

(52) U.S. Cl.
CPC ..... *F04C 18/0269* (2013.01); *F04C 29/0057* (2013.01); *F04C 29/12* (2013.01)

(58) Field of Classification Search
USPC ..... 418/55.1–55.6
See application file for complete search history.

(56) References Cited

FOREIGN PATENT DOCUMENTS

| | | | |
|---|---|---|---|
| JP | 2000-110749 | A | 4/2000 |
| JP | 2000-249084 | A | 9/2000 |

OTHER PUBLICATIONS

International Search Report of corresponding PCT Application No. PCT/JP2014/003684 dated Oct. 7, 2014.
International Preliminary Report of corresponding PCT Application No. PCT/JP2014/003684 dated Feb. 23, 2016.

* cited by examiner

SCROLL COMPRESSOR

CROSS-REFERENCE TO RELATED APPLICATIONS

This U.S. National stage application claims priority under 35 U.S.C. § 119(a) to Japanese Patent Application No. 2013-169562, filed in Japan on Aug. 19, 2013, the entire contents of which is hereby incorporated herein by reference.

TECHNICAL FIELD

The present invention relates to a scroll compressor.

BACKGROUND ART

Scroll compressors having a fixed scroll and a movable scroll, and forming a compression chamber by engaging wraps of the respective scrolls have been known. In such a scroll compressor, the movable scroll rotates eccentrically with respect to the fixed scroll, thereby sucking a low-temperature, low-pressure fluid into the compression chamber from a portion closer to the outer circumferences of the wraps, and discharging a high-temperature, high-pressure fluid, which has been compressed in the compression chamber, from a discharge port that is open at a central portion of the wraps (see, e.g., Japanese Unexamined Patent Publication No. H7-189937).

Japanese Unexamined Patent Publication No. H7-189937 discloses that in such a scroll compressor, a ratio (i.e., a compression ratio) between a pressure at the start of the intake and a pressure at the completion of the compression is uniquely decided based on the shape of the scroll, irrespective of the conditions of the pressure during operation. Thus, the pressure in the compression chamber may sometimes be lower than the discharge pressure at the moment when the compression chamber compressed to near the central portion communicates with the discharge port, and hence the fluid may flow back into the compression chamber through the discharge port. This causes pressure loss and energy loss, and further leads to increased variations in the discharge pressure. In other words, pulsation occurs when the fluid flows back into the compression chamber at once from the discharge port, and this causes a noise level increase.

To avoid this, the scroll compressor disclosed in Japanese Unexamined Patent Publication No. H7-189937 closes the discharge port with a check valve made of an elastic body. The check valve is opened/closed at the discharge of a compressed refrigerant to prevent the fluid from flowing back into the compression chamber through the discharge port. In Japanese Unexamined Patent Publication No. H7-189937, one end of the check valve in its longitudinal direction is fixed to the fixed scroll, and the check valve is disposed such that the discharge port provided at the central portion of the fixed scroll is located near a middle portion of the check valve in its longitudinal direction to reduce the impact sound generated at the moment when the check valve is closed.

SUMMARY

Technical Problem

However, although the scroll compressor disclosed in Patent Document 1 adopts a configuration which enables a reduction in the impact sound generated at the moment when the check valve is closed, the impact sound cannot be completely eliminated. Further, the check valve increases a discharge resistance of the compressed fluid when it is discharged from the discharge port, and hence decreases the efficiency of the compressor. Thus, there has been a demand for a measure which prevents a fluid from flowing back into the compression chamber at once from the discharge port without using a check valve.

In view of the foregoing, it is therefore an object of the invention to reduce pulsation that occurs when the refrigerant flows back into the compression chamber at once from a discharge port in an operation at a high compression ratio.

Solution to the Problem

The present invention is directed to a scroll compressor including: a fixed scroll (40) having a fixed end plate (41) on which a spirally-extending fixed wrap (42) is positioned upright; a movable scroll (35) having a movable end plate (36) on which a spirally-extending movable wrap (37) is positioned upright; and a crank shaft (23) coupled to a back surface side of the movable scroll (35). The fixed wrap (42) and the movable wrap (37) are engaged with each other to form a compression chamber (31) therebetween. The crank shaft (23) is driven to rotate to have the movable scroll (35) rotate eccentrically with respect to the fixed scroll (40) and discharge a refrigerant compressed in the compression chamber (31) from a discharge port (32) open at a central al portion of the fixed end plate (41). The present invention provides the following solutions.

That is, in a first aspect of the invention, the compression chamber (31) is divided into a first compression chamber (31*a*) facing an outer circumferential surface of the movable wrap (37), and a second compression chamber (31*b*) facing an inner circumferential surface of the movable wrap (37). The fixed end plate (41) or the movable end plate (36) is provided with a communication groove (33) which is recessed at a portion near a wrapping start position of the fixed wrap (42) or the movable wrap (37). The communication groove (33) connects the first compression chamber (31*a*) and the discharge port (32) before the outer circumferential surface of the movable wrap (37), which is eccentrically rotating while sliding on an inner circumferential surface of the fixed wrap (42), separates from the inner circumferential surface of the fixed wrap (42).

According to the first aspect of the invention, the compression chamber (31) is divided into a first compression chamber (31*a*) facing the outer circumferential surface of the movable wrap (37), and a second compression chamber (31*b*) facing the inner circumferential surface of the movable wrap (37). The fixed end plate (41) or the movable end plate (36) is provided with a communication groove (33) which is recessed at a portion near a wrapping start position of the fixed wrap (42) or the movable wrap (37). The first compression chamber (31*a*) and the discharge port (32) are connected to each other through the communication groove (33) before the outer circumferential surface of the movable wrap (37), which is eccentrically rotating while sliding on the inner circumferential surface of the fixed wrap (42), separates from the inner circumferential surface of the fixed wrap (42).

This configuration allows for reducing the pulsation that occurs when the refrigerant flows back into the compression chamber (31) at once from the discharge port (32) during the operation at a high compression ratio.

Specifically, during the operation at a high compression ratio, the pressure in the compression chamber (31) may sometimes be lower than the discharge pressure at the moment when the outer circumferential surface of the movable wrap (37), which is eccentrically rotating while sliding on the inner circumferential surface of the fixed wrap (42), separates from the inner circumferential surface of the fixed wrap (42). In such a case, pulsation occurs when the refrigerant flows back into the compression chamber (31) at once from the discharge port (32). This causes a noise level increase.

In the present invention, on the other hand, the high-pressure refrigerant can be gradually released into the compression chamber (31) from the discharge port (32) through the communication groove (33) before the outer circumferential surface of the movable wrap (37), which is eccentrically rotating while sliding on the inner circumferential surface of the fixed wrap (42), separates from the inner circumferential surface of the fixed wrap (42). This allows for reducing the backflow of the refrigerant into the compression chamber (31) at once from the discharge port (32), and hence allows for reducing the pulsation. Further, during the operation at a low compression ratio, too, the high-pressure refrigerant is released into the compression chamber (31) through the communication groove (33), thereby allowing for reducing occurrence of excessive compression.

Further, the provision of the communication groove (33) near the wrapping start position of the fixed wrap (42) or the movable wrap (37) allows for easing the stress applied to the wrapping start position of the fixed wrap (42) or the movable wrap (37).

Specifically, the wrapping start position of the fixed wrap (42) or the movable wrap (37) is located near the discharge port (32), and hence subjected to the highest pressure. Thus, stress is concentrated on a corner between the fixed wrap (42) and the fixed end plate (41) or a corner between the movable wrap (37) and the movable end plate (36).

In the present invention, on the other hand, the communication groove (33) is formed near the wrapping start position of the fixed wrap (42) or the movable wrap (37), and this communication groove (33) allows for distributing the stress concentrated on the corner between the wrap and the end plate, to the corner between the groove wall surface and the groove bottom surface of the communication groove (33), as well. As a result, the stress concentration on the proximal end of the wrap can be eased.

A second aspect of the invention is an embodiment of the first aspect of the invention. In the second aspect, the communication groove (33) connects the second compression chamber (31*b*) and the discharge port (32) before the inner circumferential surface of the movable wrap (37), which is eccentrically rotating while sliding on a wrapping start portion of the fixed wrap (42), separates from the wrapping start portion.

According to the second aspect, the second compression chamber (31*b*) and the discharge port (32) are connected to each other through the communication groove (33) before the inner circumferential surface of the movable wrap (37), which is eccentrically rotating while sliding on the wrapping start portion of the fixed wrap (42), separates from the wrapping start portion of the fixed wrap (42). That is, the second compression chamber (31*b*) and the discharge port (32) can be connected to each other through the communication groove (33) at a different time than when the first compression chamber (31*a*) and the discharge port (32) are connected to each other through the communication groove (33).

A third aspect of the invention is an embodiment of the first or second aspect of the invention. In the third aspect, the communication groove (33) has a stepped portion so that a groove depth decreases from the discharge port (32) in a radially outward direction.

According to the third aspect, the communication groove (33) has a stepped portion so that the groove depth decreases from the discharge port (32) in a radially outward direction. This allows for gradually releasing the refrigerant into the compression chamber (31) from the discharge port (32) through the communication groove (33).

A fourth aspect of the invention is an embodiment of the first or second aspect of the invention. In the fourth aspect, the communication groove (33) has an inclined surface so that a groove depth decreases from the discharge port (32) in a radially outward direction.

According to the fourth aspect, the communication groove (33) has an inclined surface so that the groove depth decreases from the discharge port (32) in a radially outward direction. This allows for gradually releasing the refrigerant into the compression chamber (31) from the discharge port (32) through the communication groove (33).

Advantages of the Invention

According to the present invention, the high-pressure refrigerant can be gradually released into the compression chamber (31) from the discharge port (32) through the communication groove (33) before the outer circumferential surface of the movable wrap (37), which is eccentrically rotating while sliding on the inner circumferential surface of the fixed wrap (42), separates from the inner circumferential surface of the fixed wrap (42). This allows for reducing the backflow of the refrigerant into the compression chamber (31) at once from the discharge port (32), and hence allows for reducing the pulsation. Further, during the operation at a low compression ratio, too, the high-pressure refrigerant is released into the compression chamber (31) through the communication groove (33), thereby allowing for reducing occurrence of excessive compression.

Moreover, the communication groove (33) is formed near the wrapping start position of the fixed wrap (42) or the movable wrap (37), and this communication groove (33) allows for distributing the stress concentrated on the corner between the wrap and the end plate, to the corner between the groove wall surface and the groove bottom surface of the communication groove (33), as well. As a result, the stress applied to the wrapping start position of the fixed wrap (42) or the movable wrap (37) can be reduced.

DESCRIPTION OF EMBODIMENTS

The embodiments of the present invention will be described below, based on the drawings. The following embodiments are merely preferred examples in nature, and are not intended to limit the scope, applications, and use of the invention.

First Embodiment

Figure 1:
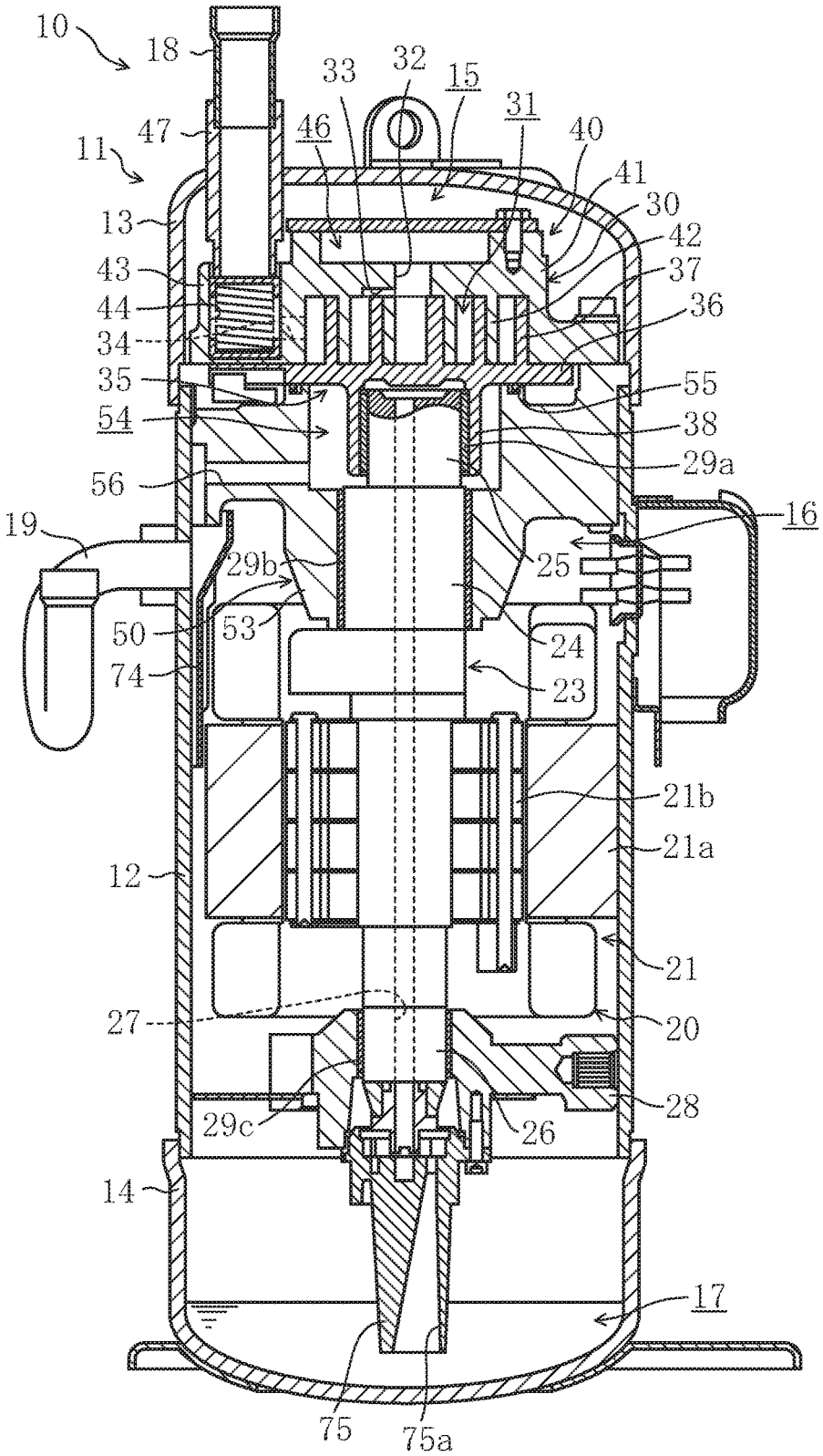
FIG. 1 is a longitudinal cross section illustrating a configuration of a scroll compressor of a first embodiment of the present invention.

FIG. 1 is a longitudinal cross section illustrating a configuration of a scroll compressor of a first embodiment of the present invention. The scroll compressor (10) is connected, for example, to a refrigerant circuit which performs a vapor compression refrigeration cycle in an air conditioner. The scroll compressor (10) has a casing (11), a rotatory compression mechanism (30), and a drive mechanism (20) which drives and rotates the compression mechanism (30).

The casing (11) is configured as a vertically-oriented, hermetic cylindrical container with both ends closed, and includes a cylindrical body (12), an upper end plate (13) fixed to the upper end of the body (12), and a lower end plate (14) fixed to the lower end of the body (12).

The interior of the casing (11) is divided into upper and lower spaces by a housing (50) connected to the inner circumferential surface of the casing (11). The space above the housing (50) forms an upper space (15), and the space under the housing (50) forms a lower space (16). The configuration of the housing (50) will be described in detail later.

The lower space (16) of the casing (11) is provided, at the bottom thereof, with an oil reservoir (17) where oil for lubricating a sliding portion of the scroll compressor (10) is accumulated.

An intake pipe (18) and a discharge pipe (19) are attached to the casing (11). One end of the intake pipe (18) is connected to an intake pipe coupling (47). The discharge pipe (19) passes through the body (12). One end of the discharge pipe (19) is open to the lower space (16) of the casing (11).

The drive mechanism (20) includes a motor (21) and a crank shaft (23). The motor (21) is housed in the lower space (16) of the casing (11). The motor (21) includes a stator (21*a*) and a rotor (21*b*) in a cylindrical shape. The stator (21*a*) is fixed to the body (12) of the casing (11).

The rotor (21*b*) is disposed in the hollow portion of the stator (21*a*). The crank shaft (23) passes through, and fixed to, the hollow portion of the rotor (21*b*). The rotor (21*b*) and the crank shaft (23) rotate in an integrated manner.

The crank shaft (23) includes a vertically-extending main shaft (24), and an integrally-formed eccentric portion (25) at an upper portion of the main shaft (24). The eccentric portion (25) has a smaller diameter than the maximum diameter of the main shaft (24). The axial center of the eccentric portion (25) is eccentric with respect to the axial center of the main shaft (24) by a predetermined distance. The lower end portion (i.e., a lower main shaft (26)) of the main shaft (24) of the crank shaft (23) is rotatably supported on a lower bearing (28) fixed to the body (12) of the casing (11) near the lower end of the body (12). Further, the upper end portion of the main shaft (24) is rotatably supported on a bearing (53) disposed in the housing (50). An oil supply channel (27) extending along the axial center of the crank shaft (23) is formed in the crank shaft (23).

An intake nozzle (75) as an intake member for drawing up the oil is provided at a lower end portion of the crank shaft (23). The intake nozzle (75) serves as a positive displacement pump. The intake nozzle (75) has an intake opening (75*a*) open to the oil reservoir (17) in the casing (11). The discharge port of the intake nozzle (75) is connected to, and communicates with, the oil supply channel (27) in the crank shaft (23). The oil drawn up from the oil reservoir (17) by the intake nozzle (75) flows through the oil supply channel (27) and is supplied to the sliding portion of the scroll compressor (10).

The compression mechanism (30) is a so-called scroll type compression mechanism having a movable scroll (35), a fixed scroll (40), and the housing (50). The housing (50) and the fixed scroll (40) are fastened to each other with a bolt, and the movable scroll (35) is held between the housing (50) and the fixed scroll (40).

The movable scroll (35) has a movable end plate (36) approximately in the shape of a disc. A movable wrap (37) is provided upright on the upper surface of the movable end plate (36). The movable wrap (37) is a wall spirally extending outward in a radial direction from a portion near the center of the movable end plate (36). Further, the movable end plate (36) is provided with a boss (38) protruding from the lower surface of the movable end plate (36).

The fixed scroll (40) has a fixed end plate (41) approximately in the shape of a disc. A fixed wrap (42) is provided upright on the lower surface of the fixed end plate (41). The fixed wrap (42) is a wall spirally extending outward in the radial direction from a portion near the center of the fixed end plate (41), and is configured to be engaged with the movable wrap (37) of the movable scroll (35). A compression chamber (31) is formed between the fixed wrap (42) and the movable wrap (37).

Figure 2:
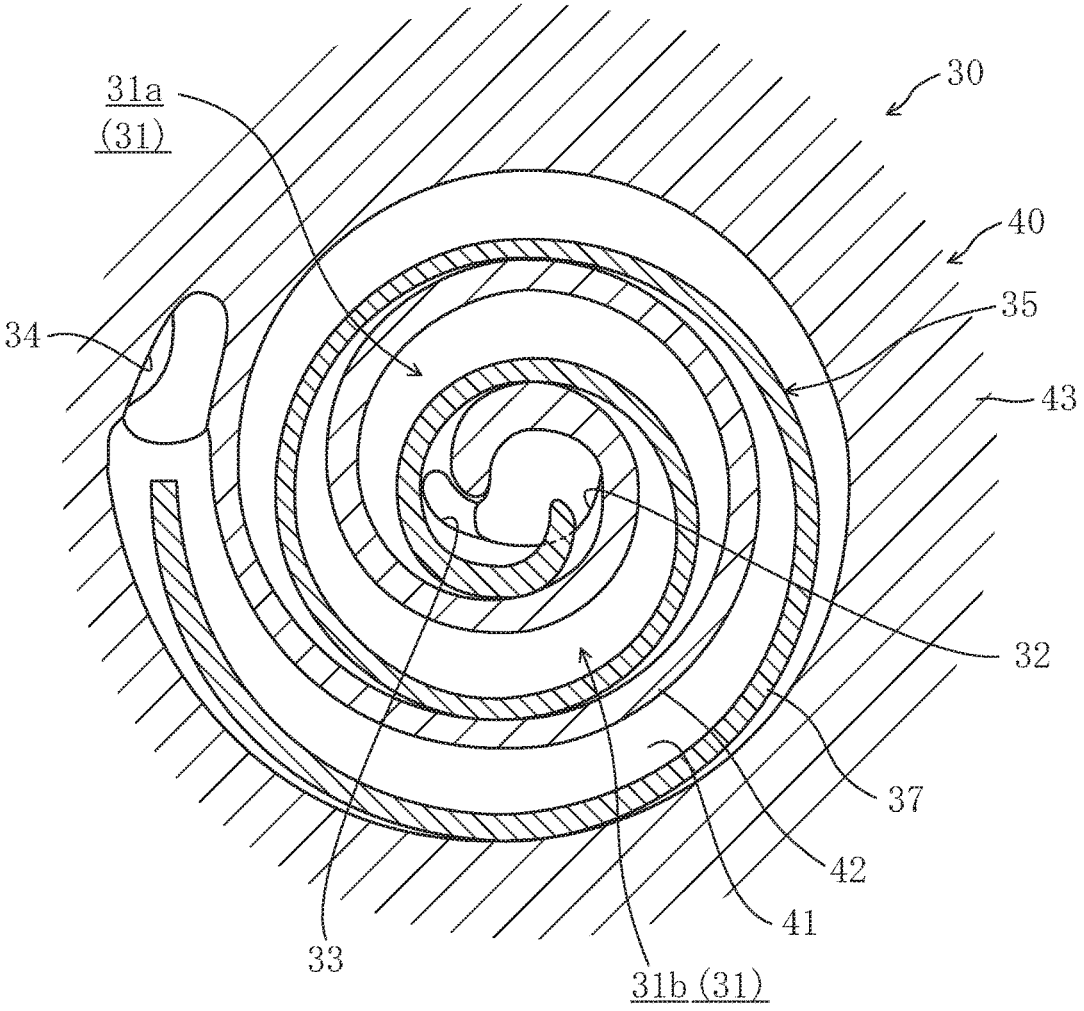
FIG. 2 is a cross-sectional view illustrating a configuration of the scroll compressor.

As illustrated in FIG. 2, the compression chamber (31) is divided into a first compression chamber (31*a*) facing the outer circumferential surface of the movable wrap (37), and a second compression chamber (31*b*) facing the inner circumferential surface of the movable wrap (37).

The fixed scroll (40) has an outer edge portion (43) continuous from the outermost circumferential surface of the fixed wrap (42) and extending outward in the radial direction. The lower end surface of this outer edge portion (43) is fixed to the upper end surface of the housing (50). Further, the outer edge portion (43) is provided with an opening (44) that is open upward. An intake port (34) which connects the interior of the opening (44) and the outermost end of the compression chamber (31) is formed in the outer edge portion (43). The intake port (34) is open at an intake portion of the compression chamber (31). Note that the above-described intake pipe coupling (47) is connected to the opening (44) of the outer edge portion (43).

The fixed end plate (41) of the fixed scroll (40) is provided with a discharge port (32) located at a portion close to the center of the fixed wrap (42) and vertically passing through the fixed end plate (41). The lower end of the discharge port (32) is open at a discharge portion of the compression chamber (31). The upper end of the discharge port (32) is open to a discharge chamber (46) defined in an upper portion of the fixed scroll (40). Although not shown, the discharge chamber (46) communicates with the lower space (16) of the casing (11).

Figure 3:
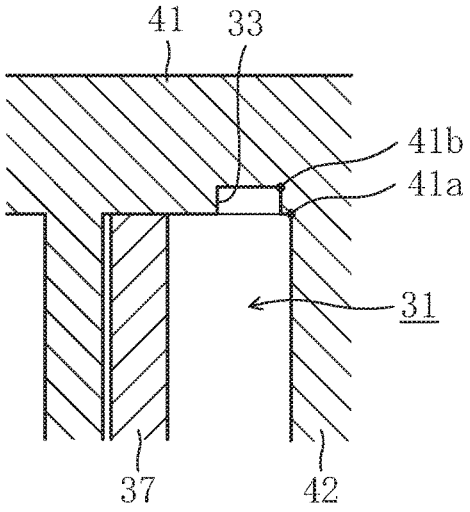
FIG. 3 is a longitudinal cross section illustrating a configuration of a communication groove.

The fixed end plate (41) of the fixed scroll (40) is provided with a communication groove (33) which is recessed at a portion near a wrapping start position of the fixed wrap (42). As illustrated in FIG. 3, the communication groove (33) is recessed at a position away from the outer circumferential surface of the fixed wrap (42) by a predetermined distance, and extends along the outer circumferential surface of the fixed wrap (42).

The provision of the communication groove (33) near the wrapping start position of the fixed wrap (42) allows for reducing the stress applied to the wrapping start position of the fixed wrap (42).

Specifically, the pressure at the wrapping start position of the fixed wrap (42) is the highest, since the wrapping start position of the fixed wrap (42) is located near the discharge port (32). The communication groove (33) formed near the wrapping start position of the fixed wrap (42) distributes the stress concentrated on a corner (41*a*) between the outer circumferential surface of the fixed wrap (42) and the bottom surface of the fixed end plate (41), to a corner (41*b*) between the groove wall surface and the groove bottom surface of the communication groove (33), as well. As a result, the stress concentration on the proximal end of the fixed wrap (42) can be eased.

Figure 4:
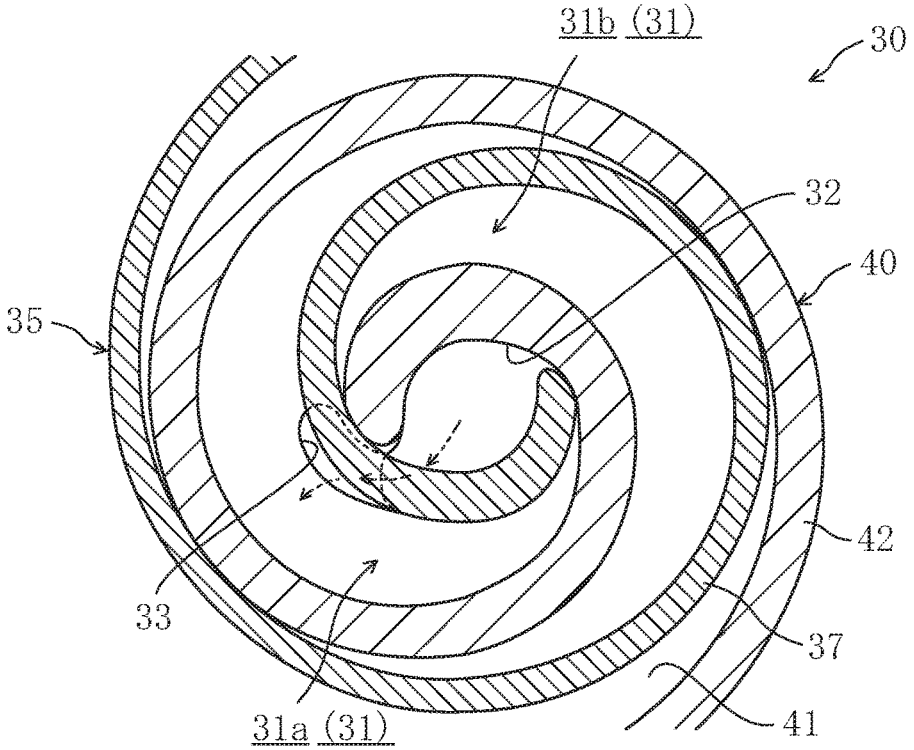
FIG. 4 is a cross-sectional view illustrating the state before the outer circumferential surface of the movable wrap, which is eccentrically rotating while sliding on the inner circumferential surface of the fixed wrap, separates from the inner circumferential surface of the fixed wrap.

Further, as illustrated in FIG. 4, the communication groove (33) is configured to connect the first compression chamber (31*a*) and the discharge port (32) before the outer circumferential surface of the movable wrap (37), which is eccentrically rotating while sliding on the inner circumferential surface of the fixed wrap (42), separates from the inner circumferential surface of the fixed wrap (42). This configuration allows for reducing the pulsation that occurs when the refrigerant flows back into the first compression chamber (31*a*) at once from the discharge port (32) in an operation at a high compression ratio.

Specifically, if the communication groove (33) is not formed, the discharge port (32) and the first compression chamber (31*a*) communicate with each other when the outer circumferential surface of the movable wrap (37) separates from the inner circumferential surface of the fixed wrap (42), causing the refrigerant to flow back into the first compression chamber (31*a*) at once from the discharge port (32).

On the other hand, in this embodiment, the high-pressure refrigerant can be gradually released into the first compression chamber (31*a*) from the discharge port (32) through the communication groove (33) before the outer circumferential surface of the movable wrap (37) separates from the inner circumferential surface of the fixed wrap (42). This allows for reducing the backflow of the refrigerant into the first compression chamber (31*a*) at once from the discharge port (32), and thereby reducing the pulsation.

Figure 5:
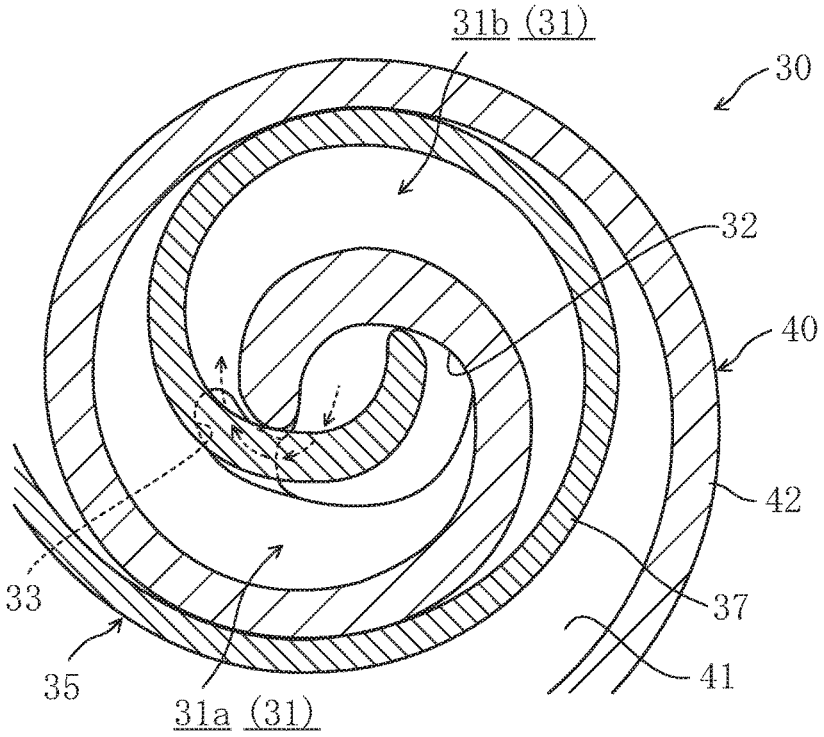
FIG. 5 is a cross-sectional view illustrating the state before the inner circumferential surface of the movable wrap, which is eccentrically rotating while sliding on a wrapping start portion of the fixed wrap, separates from the wrapping start portion.

Further, as illustrated in FIG. 5, the communication groove (33) is configured to connect the second compression chamber (31*b*) and the discharge port (32) before the inner circumferential surface of the movable wrap (37), which is eccentrically rotating while sliding on the wrapping start portion of the fixed wrap (42), separates from the wrapping start portion of the fixed wrap (42). That is, the communication groove (33) enables the second compression chamber (31*b*) and the discharge port (32) to connect with each other at a different time than when the first compression chamber (31*a*) and the discharge port (32) connects with each other through the communication groove (33).

In this manner, the high-pressure refrigerant can be gradually released into the second compression chamber (31*b*) from the discharge port (32) through the communication groove (33) before the inner circumferential surface of the movable wrap (37) separates from the wrapping start portion of the fixed wrap (42). This allows for reducing the backflow of the refrigerant into the second compression chamber (31*b*) at once from the discharge port (32), thereby reducing the pulsation.

As illustrated in FIG. 1, the housing (50) is in an approximately cylindrical shape. The outer circumferential surface of the housing (50) has a larger diameter at its upper portion than at its lower portion. The upper portion of this outer circumferential surface is fixed to the inner circumferential surface of the casing (11).

The crank shaft (23) is inserted in a hollow portion of the housing (50). Further, the hollow portion has a larger diameter at its upper portion than at is lower portion. The bearing (53) is provided at this lower portion of the hollow portion. The bearing (53) rotatably supports the upper end portion of the main shaft (24) of the crank shaft (23). The upper portion of the hollow portion is partitioned by a sealing member (55) and serves as a crank chamber (54). The crank chamber (54) faces the back surface of the movable scroll (35). The sealing member (55) is fitted in between the upper surface of the housing (50) and the back surface of the movable scroll (35). The boss (38) of the movable scroll (35) is located in the crank chamber (54). The eccentric portion (25) of the crank shaft (23) which protrudes from the upper end of the bearing (53) engages with this boss (38). The compression mechanism (30) is driven to rotate by the crank shaft (23).

A first slide bearing (29*a*) which rotatably supports the eccentric portion (25) of the crank shaft (23) is inserted in the boss (38). A second slide bearing (29*b*) which rotatably supports the main shaft (24) of the crank shaft (23) is inserted in the bearing (53). A third slide bearing (29*c*) which rotatably supports the lower main shaft (26) of the crank shaft (23) is inserted in the lower bearing (28).

The oil which has passed through the oil supply channel (27) of the crank shaft (23) is supplied in between the first slide bearing (29*a*) and the eccentric portion (25), and thereafter flows into the crank chamber (54). Thus, the crank chamber (54) has the same pressure as the pressure in the lower space (16) of the casing (11). This pressure of the crank chamber (54) acts on the back surface of the movable scroll (35), and pushes the movable scroll (35) against the fixed scroll (40).

The housing (50) is provided with an oil discharge passage (56). The oil which has flowed into the crank chamber (54) passes through the oil discharge passage (56) to be discharged to the outside of the housing (50), and is collected into the oil reservoir (17).

—Operation—

Now, the operation of the above-described scroll compressor (10) will be described. When the motor (21) of the scroll compressor (10) is activated, the rotor (21*b*) and the crank shaft (23) rotate together, making the movable scroll (35) revolve around. The capacity of the compression chamber (31) periodically increases and decreases as the movable scroll (35) revolves around.

Specifically, when the crank shaft (23) rotates, the refrigerant is sucked into the compression chamber (31) through the intake port (34). The compression chamber (31) is completely closed with the rotation of the crank shaft (23). Further, as the rotation of the crank shaft (23) proceeds, the capacity of the compression chamber (31) starts to decrease, and the refrigerant starts to be compressed in the compression chamber (31).

The capacity of the compression chamber (31) further decreases with time. The discharge port (32) opens when the capacity of the compression chamber (31) decreases to a predetermined capacity. Through this discharge port (32), the refrigerant compressed in the compression chamber (31) is discharged to the discharge chamber (46) of the fixed scroll (40). The refrigerant in the discharge chamber (46) passes through the lower space (16) of the casing (11) and is discharged from the discharge pipe (19). As mentioned earlier, the lower space (16) communicates with the crank chamber (54). The movable scroll (35) is pushed against the fixed scroll (40) by the refrigerant pressure in the crank chamber (54).

Second Embodiment

Figure 6:
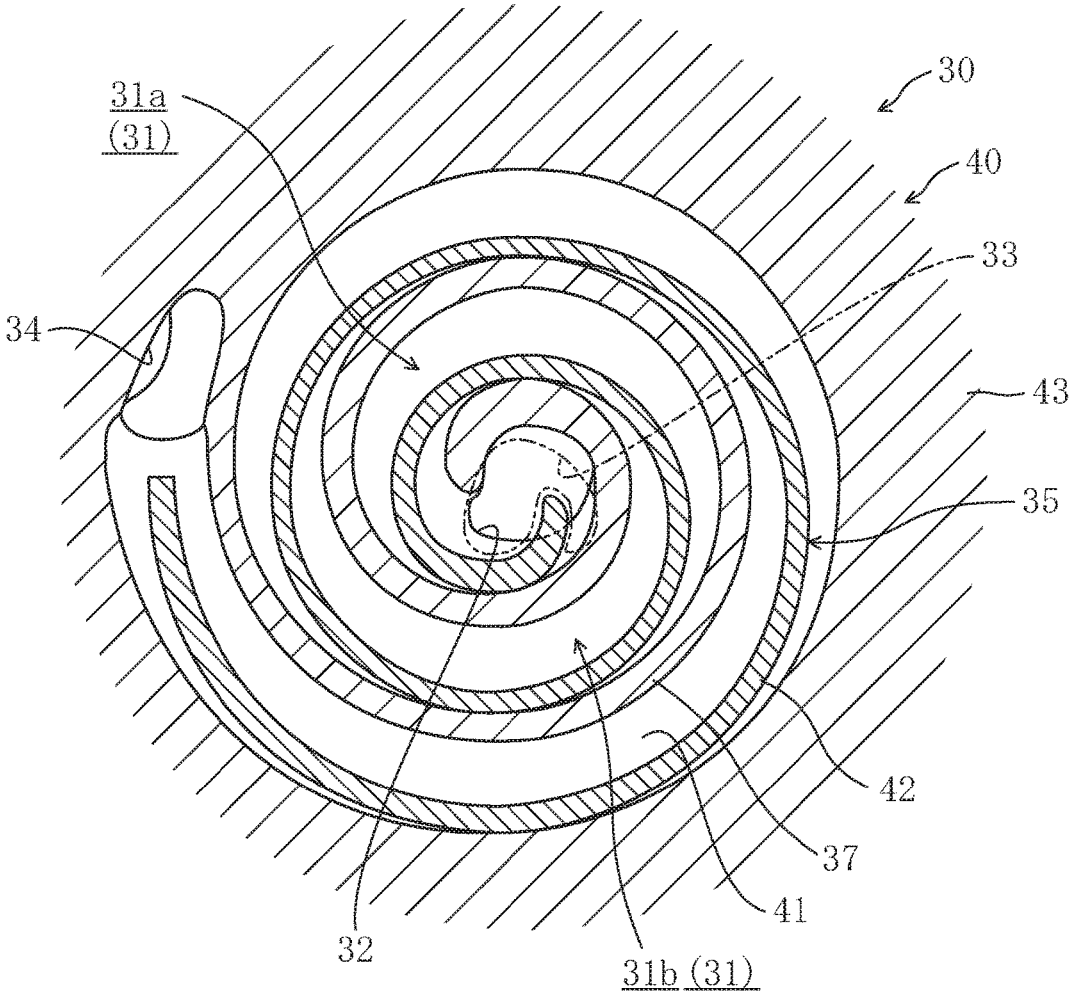
FIG. 6 is a cross-sectional view illustrating a configuration of a scroll compressor of a second embodiment.

FIG. 6 is a cross-sectional view illustrating a configuration of a scroll compressor of a second embodiment. The second embodiment differs from the first embodiment only in that the communication groove (33) is formed in the movable scroll (35). Thus, the same reference characters are used to designate the same elements as those in the first embodiment, and only the difference will be explained.

Figure 7:
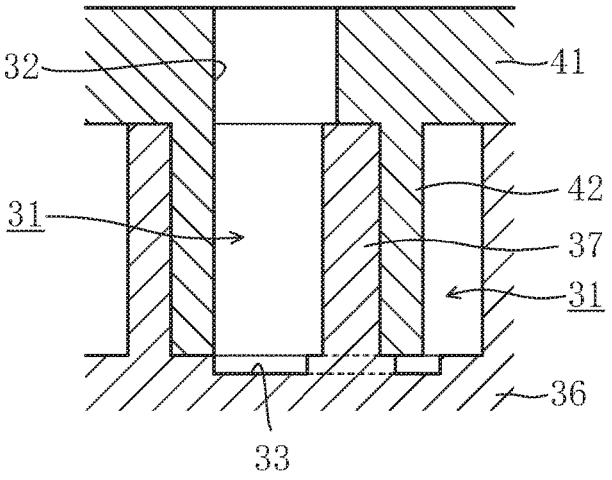
FIG. 7 is a longitudinal cross section illustrating a configuration of the communication groove.

As illustrated in FIGS. 6 and 7, the movable end plate (36) of the movable scroll (35) is provided with a communication groove (33) which is recessed at a portion near a wrapping start position of the movable wrap (37). In FIG. 6, the communication groove (33) is shown by an imaginary line. The communication groove (33) is recessed at a position away from the outer circumferential surface of the movable wrap (37) by a predetermined distance, and extends along the outer circumferential surface of the movable wrap (37).

The provision of the communication groove (33) near the wrapping start position of the movable wrap (37) allows for distributing the stress concentrated on a corner between the outer circumferential surface of the movable wrap (37) and the upper surface of the movable end plate (36), to a corner between the groove wall surface and the groove bottom surface of the communication groove (33), as well. This reduces the stress applied to the wrapping start position of the movable wrap (37), and allows for easing the stress concentration on the proximal end of the movable wrap (37).

Figure 8:
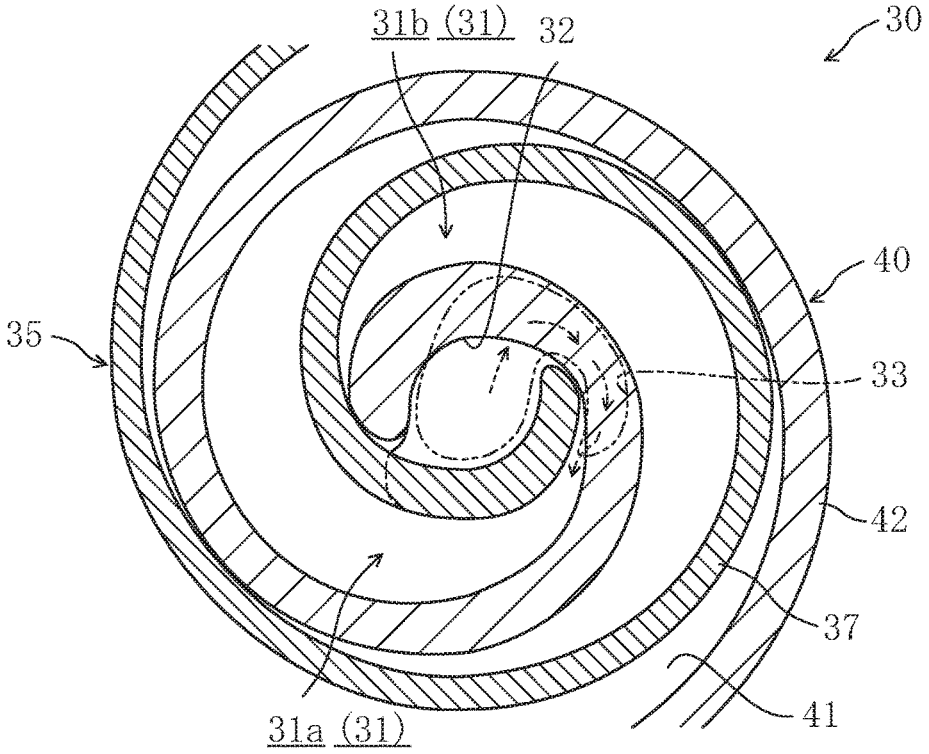
FIG. 8 is a cross-sectional view illustrating the state before the outer circumferential surface of the movable wrap, which is eccentrically rotating while sliding on the inner circumferential surface of the fixed wrap, separates from the inner circumferential surface of the fixed wrap.

Further, as illustrated in FIG. 8, the communication groove (33) is configured to connect the first compression chamber (31*a*) and the discharge port (32) before the outer circumferential surface of the movable wrap (37), which is eccentrically rotating while sliding on the inner circumferential surface of the fixed wrap (42), separates from the inner circumferential surface of the fixed wrap (42). This configuration allows for gradually releasing the high-pressure refrigerant from the discharge port (32) into the first compression chamber (31*a*) through the communication groove (33) before the outer circumferential surface of the movable wrap (37) separates from the inner circumferential surface of the fixed wrap (42).

Figure 9:
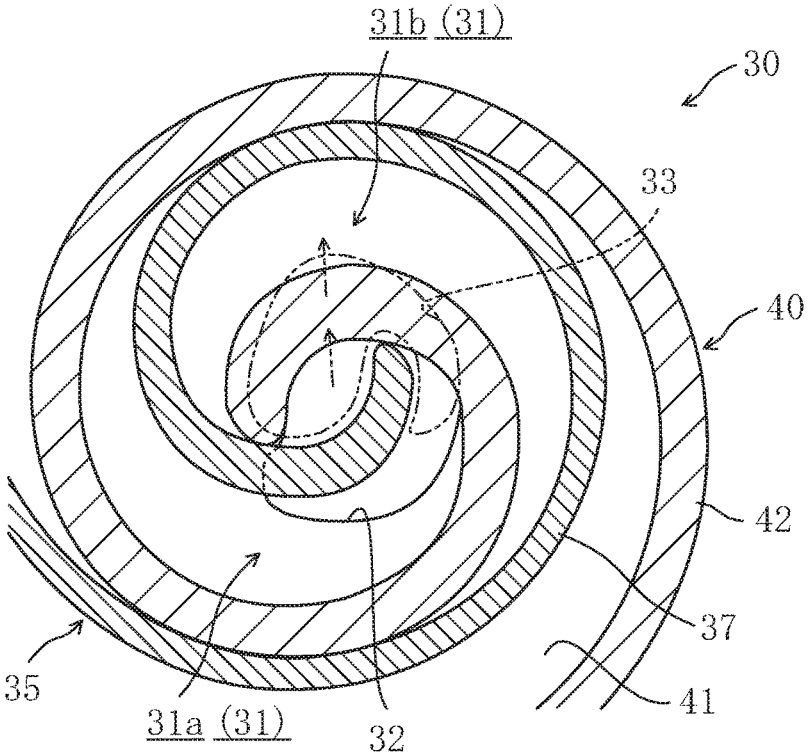
FIG. 9 is a cross-sectional view illustrating the state before the inner circumferential surface of the movable wrap, which is eccentrically rotating while sliding on the wrapping start portion of the fixed wrap, separates from the wrapping start portion.

Further, as illustrated in FIG. 9, the communication groove (33) is configured to connect the second compression chamber (31*b*) and the discharge port (32) before the inner circumferential surface of the movable wrap (37), which is eccentrically rotating while sliding on the wrapping start portion of the fixed wrap (42), separates from the wrapping start portion of the fixed wrap (42). This configuration allows for gradually releasing the high-pressure refrigerant from the discharge port (32) into the second compression chamber (31*b*) through the communication groove (33) before the inner circumferential surface of the movable wrap (37) separates from the wrapping start portion of the fixed wrap (42).

First Variation

Figure 10:
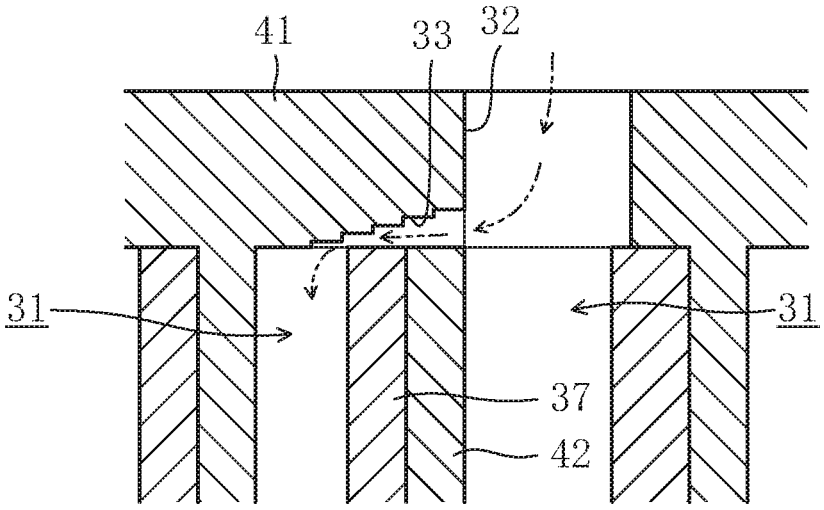
FIG. 10 is a longitudinal cross section illustrating a configuration of a communication groove of a first variation.

FIG. 10 is a longitudinal cross section illustrating a configuration of a communication groove of a first variation. As illustrated in FIG. 10, the communication groove (33) has stepped portions so that the depth of the groove decreases from the discharge port (32) in a radially outward direction. This structure allows for gradually releasing the refrigerant from the discharge port into the compression chamber (31) through the communication groove (33).

Second Variation

Figure 11:
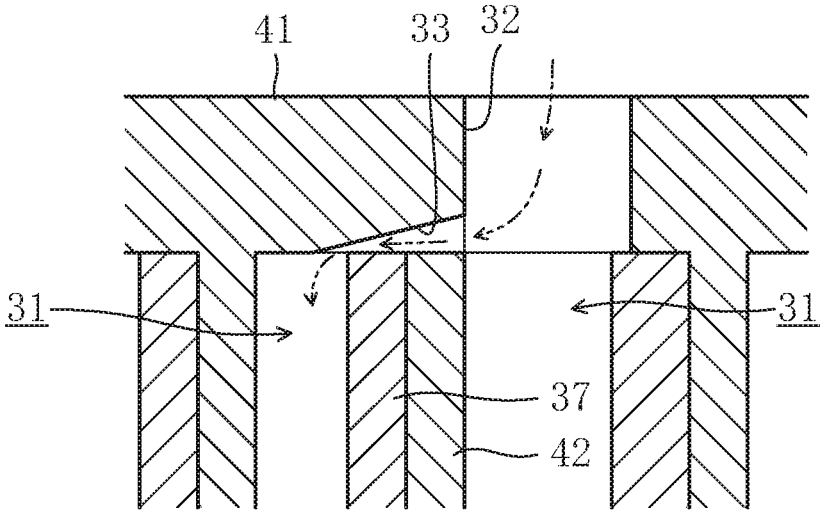
FIG. 11 is a longitudinal cross section illustrating a configuration of a communication groove of a second variation.

FIG. 11 is a longitudinal cross section illustrating a configuration of a communication groove of a second variation. As illustrated in FIG. 11, the communication groove (33) has an inclined surface so that the depth of the groove decreases from the discharge port (32) in the radially outward direction. This structure allows for gradually releasing the refrigerant from the discharge port (32) into the compression chamber (31) through the communication groove (33).

INDUSTRIAL APPLICABILITY

As can be seen from the foregoing description, the present invention is very useful and is highly applicable to the industry, since it allows for reducing the pulsation that occurs when a refrigerant flows back into a compression chamber at once from a discharge port in an operation at a high compression ratio.

What is claimed is:

1. A scroll compressor, comprising:

a fixed scroll having a fixed end plate with a spirally-extending fixed wrap positioned upright on the fixed end plate;

a movable scroll having a movable end plate with a spirally-extending movable wrap positioned upright on the movable end plate; and a crank shaft coupled to a back surface side of the movable scroll, the fixed wrap and the movable wrap being engaged with each other to form a compression chamber therebetween, the crank shaft being driven to rotate to have the movable scroll rotate eccentrically with respect to the fixed scroll and discharge a refrigerant compressed in the compression chamber from a discharge port open at a central portion of the fixed end plate, the compression chamber being divided into a first compression chamber facing an outer circumferential surface of the movable wrap, and a second compression chamber facing an inner circumferential surface of the movable wrap, one of the fixed end plate and the movable end plate being provided with a communication groove recessed at a portion near a wrapping start position of one of the fixed wrap and the movable wrap, the communication groove connecting the first compression chamber and the discharge port before the outer circumferential surface of the movable wrap, which is eccentrically rotating while sliding on an inner circumferential surface of the fixed wrap, separates from the inner circumferential surface of the fixed wrap, so that a high-pressure refrigerant is gradually released into the first compression chamber from the discharge port, and the communication groove connecting the second compression chamber and the discharge port before the inner circumferential surface of the movable wrap, which is eccentrically rotating while sliding on a wrapping start portion of the fixed wrap, separates from the wrapping start portion, so that a high-pressure refrigerant is gradually released into the second compression chamber from the discharge port.

2. A scroll compressor, comprising:

a fixed scroll having a fixed end plate with a spirally-extending fixed wrap positioned upright on the fixed end plate;

a movable scroll having a movable end plate with a spirally-extending movable wrap positioned upright on the movable end plate, and a crank shaft coupled to a back surface side of the movable scroll, the fixed wrap and the movable wrap being engaged with each other to form a compression chamber therebetween, the crank shaft being driven to rotate to have the movable scroll rotate eccentrically with respect to the fixed scroll and discharge a refrigerant compressed in the compression chamber from a discharge port open at a central portion of the fixed end plate, the compression chamber being divided into a first compression chamber facing an outer circumferential surface of the movable wrap, and a second compression chamber facing an inner circumferential surface of the movable wrap, one of the fixed end plate and the movable end plate being provided with a communication groove recessed at a portion near a wrapping start position of one of the fixed wrap and the movable wrap, the communication groove connecting the first compression chamber and the discharge port before the outer circumferential surface of the movable wrap, which is eccentrically rotating while sliding on an inner circumferential surface of the fixed wrap, separates from the inner circumferential surface of the fixed wrap, and the communication groove having a stepped portion so that a groove depth decreases from the discharge port in a radially outward direction.

3. A scroll compressor, comprising:

a fixed scroll having a fixed end plate with a spirally-extending fixed wrap positioned upright on the fixed end plate;

a movable scroll having a movable end plate with a spirally-extending movable wrap positioned upright on the movable end plate; and a crank shaft coupled to a back surface side of the movable scroll, the fixed wrap and the movable wrap being engaged with each other to form a compression chamber therebetween, the crank shaft being driven to rotate to have the movable scroll rotate eccentrically with respect to the fixed scroll and discharge a refrigerant compressed in the compression chamber from a discharge port open at a central portion of the fixed end plate, the compression chamber being divided into a first compression chamber facing an outer circumferential surface of the movable wrap, and a second compression chamber facing an inner circumferential surface of the movable wrap, one of the fixed end plate and the movable end plate being provided with a communication groove recessed at a portion near a wrapping start position of one of the fixed wrap and the movable wrap, the communication groove connecting the first compression chamber and the discharge port before the outer circumferential surface of the movable wrap, which is eccentrically rotating while sliding on an inner circumferential surface of the fixed wrap, separates from the inner circumferential surface of the fixed wrap, and the communication groove having an inclined surface so that a groove depth decreases from the discharge port in a radially outward direction.

4. The scroll compressor of claim 1, wherein the communication groove has a stepped portion so that a groove depth decreases from the discharge port in a radially outward direction.

5. The scroll compressor of claim 1, wherein the communication groove has an inclined surface so that a groove depth decreases from the discharge port in a radially outward direction.

6. The scroll compressor of claim 2, wherein the communication groove connects the second compression chamber and the discharge port before the inner circumferential surface of the movable wrap, which is eccentrically rotating while sliding on a wrapping start portion of the fixed wrap, separates from the wrapping start portion.

7. The scroll compressor of claim 3, wherein the communication groove connects the second compression chamber and the discharge port before the inner circumferential surface of the movable wrap, which is eccentrically rotating while sliding on a wrapping start portion of the fixed wrap, separates from the wrapping start portion.

* * * * *